US006626019B1

(12) United States Patent
Huang

(10) Patent No.: US 6,626,019 B1
(45) Date of Patent: Sep. 30, 2003

(54) COVER ASSEMBLING STRUCTURE OF KEY RING

(76) Inventor: Chin-Lin Huang, 5, Kuang Cheng St., Panchiao 220, Taipei Hsien (TW)

( * ) Notice: Subject to any disclaimer, the term of this patent is extended or adjusted under 35 U.S.C. 154(b) by 0 days.

(21) Appl. No.: 10/214,168

(22) Filed: Aug. 8, 2002

(51) Int. Cl.[7] ..... A44B 15/00; A47G 29/10

(52) U.S. Cl. ..... 70/456 R; 70/257; 70/408; 362/116; 362/196

(58) Field of Search ..... 70/408, 257, 456 R, 70/454, 395, 278.2, 278.3; 206/37.1, 38.1; 362/100, 116, 196

(56) References Cited

U.S. PATENT DOCUMENTS

| | | | | | |
|---|---|---|---|---|---|
| 5,475,368 | A | * | 12/1995 | Collins | 340/573 |
| 6,006,562 | A | * | 12/1999 | Wolter | 70/456 R |
| 6,182,484 | B1 | * | 2/2001 | Wolter | 70/395 |
| 6,299,323 | B1 | * | 10/2001 | Yu et al. | 362/116 |
| 6,471,064 | B2 | * | 10/2002 | Gordon | 206/534 |
| 6,511,214 | B1 | * | 1/2003 | Parsons et al. | 362/398 |
| 6,523,973 | B2 | * | 2/2003 | Galli | 362/200 |
| 2002/0135999 | A1 | * | 9/2002 | Chen | 362/116 |
| 2003/0000267 | A1 | * | 1/2003 | Jacob et al. | 70/399 |
| 2003/0074938 | A1 | * | 4/2003 | Seki | 70/408 |

FOREIGN PATENT DOCUMENTS

| | | | | |
|---|---|---|---|---|
| GB | 461719 | * | 2/1937 | 70/456 R |
| GB | 2187227 | * | 9/1987 | 70/278.3 |

* cited by examiner

*Primary Examiner*—Lloyd A. Gall
(74) *Attorney, Agent, or Firm*—Bacon & Thomas, PLLC

(57) ABSTRACT

An improved cover assembling structure of a key ring, the key ring has a main body being provided respectively on an upper and a lower surface thereof with recesses that are provided at middle peripheral sections of the lateral sides of the main body with notches, at least an insertion hole is provided at each middle section of the recesses of the upper and lower surfaces. The upper and lower covers have contours in coincidence with those of the recesses, and have lateral wing pieces for inserting into the notches. Thereby, the upper and lower covers can be inserted into the recesses; insertion stubs provided on the upper and lower covers are insertion engaged with the insertion holes on the main body to complete assembling of the key ring. The upper and lower covers are mutually connected at the middle peripheral sections of the lateral sides of the main body by the lateral wing pieces, these connecting areas will be the prying areas for dismantling the assembly of the key ring, the prying areas are hidden in the notches provided at the middle peripheral sections of the lateral sides of the main body in order to avoid prying the upper and lower covers during use.

7 Claims, 2 Drawing Sheets

COVER ASSEMBLING STRUCTURE OF KEY RING

BACKGROUND OF THE INVENTION

1. Field of the Invention

The present invention is related to an improved cover assembling structure of a key ring; and especially to such a structure able to make fast and stable assembling of an upper and a lower cover with the main body of the key ring, and after assembling, the upper and the lower covers can be completely embedded respectively in a recess on the main body to form an integrated and smooth surface on the main body. The upper and the lower covers are connected with each other at middle peripheral sections of the lateral sides of the main body by means of lateral wing pieces, and these connecting areas will be the prying areas for dismantling the assembly. The prying area is hidden in notches provided at middle peripheral sections of the lateral sides of the main body, in order to avoid prying the upper and the lower covers during use.

2. Description of the Prior Art

A conventional key ring has, in addition to the function for hanging and collecting keys for classifying and management, the function of combining with a remote control, an alarm or an illuminating lamp by designing its modeling or increasing of some auxiliary elements; thereby, the structure of the entire key ring must be provided, in addition to with the necessary basic shape for hanging, with a structure portion for assembling the covers in favor of installing the auxiliary elements; and by increasing the structure portion for assembling, modeling of the key ring can thus be increased.

The structure portion for assembling of the conventional key ring mostly is comprised of two parts of a main body capable of closing together, a receiving space formed by closing of the two parts of the main body can be used to install therein the auxiliary elements; thereby the two parts of the main body closed to each other can form an obscuring protection function for the auxiliary elements. However, such mode of closing will make the junction of the two parts of the main body surround the lateral side of the key ring, the two parts of the main body will thereby be subjected to separation by collision by the fingers or other things, this can make the structure of the key ring scatter. In view of this, locking screws are required, or a more complicated combining way is required to make connecting of the main body firmer. Thereby, not only complication of assembling the entire key ring is increased, but also dismantling of the key ring is relatively increased. Hence maintenance and repairing of the auxiliary elements of the key ring and changing of batteries afterwards will become more inconvenient.

SUMMARY OF THE INVENTION

Therefore, the improved cover assembling structure of a key ring of the present invention is provided respectively on an upper and a lower surface of the main body of a key ring with recesses for embedding therein respectively an upper and a lower cover. The recesses are provided at middle peripheral sections of the lateral sides of the main body with notches, and at least an insertion hole is provided in each of the areas at the middle sections of the recesses of the upper and the lower surfaces. The upper and the lower covers have contours in coincidence respectively with those of the recesses, and are provided with lateral wing pieces for inserting into the notches; the inner sides of the upper and the lower covers to be covered over the main body are provided with insertion stubs in corresponding to the insert ion holes. The thickness of the upper and the lower covers as well as the lateral wing pieces is respectively exactly same as the depths of the recesses of the main body and the notches. The upper and the lower covers are put on to cover the recesses of the main body, and the insertion stubs provided on the upper and the lower covers are insertion engaged with the insertion holes provided on the main body to complete assembling of the entire key ring. Now, the upper and the lower covers are completely embedded respectively in the recesses on the main body to form a firm key ring structure with an integrated and smooth surface. And this is the primary object of the present invention.

The secondary object of the improved cover assembling structure of a key ring of the present invention is to provide an electric element which is an LED member, and the main body is made of elastic, transparent as well as insulating material, the LED member directly irradiate through the transparent main body, while the remaining light thereof is led to the contrary direction, so that the entire key ring gets an effect of light emitting, this is different from a conventional light source only with direct irradiation.

Another object of the improved cover assembling structure of a key ring of the present invention is that: the upper and the lower covers are connected at middle peripheral sections of the lateral sides of the main body, and these connecting areas will be the prying areas for dismantling the assembly. The prying areas are hidden in notches provided at middle peripheral sections of the lateral sides of the main body, in order to avoid prying the upper and the lower covers during use.

A further object of the improved cover assembling structure of a key ring of the present invention is that: the recess on one of the upper and the lower surfaces of the main body is provided therein with a battery insertion seat and an electric element insertion seat, and is provided therein with the accessories including a battery and an electric element. The cover of the upper and the lower covers in corresponding to the recess is provided thereon with a push button for controlling turning on/off of the power line connecting the battery and the electric element, so that a user can directly control operation of the accessories on the cover.

The present invention will be apparent after reading the detailed description of the preferred embodiment thereof in reference to the accompanying drawings.

DETAILED DESCRIPTION OF THE PREFERRED EMBODIMENT

Figure 1:
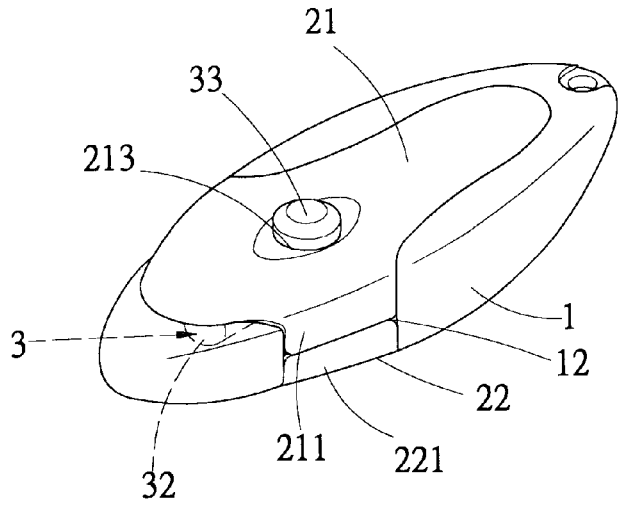
FIG. 1 is a perspective view showing the appearance of the entire key ring of the present invention.
Figure 2:
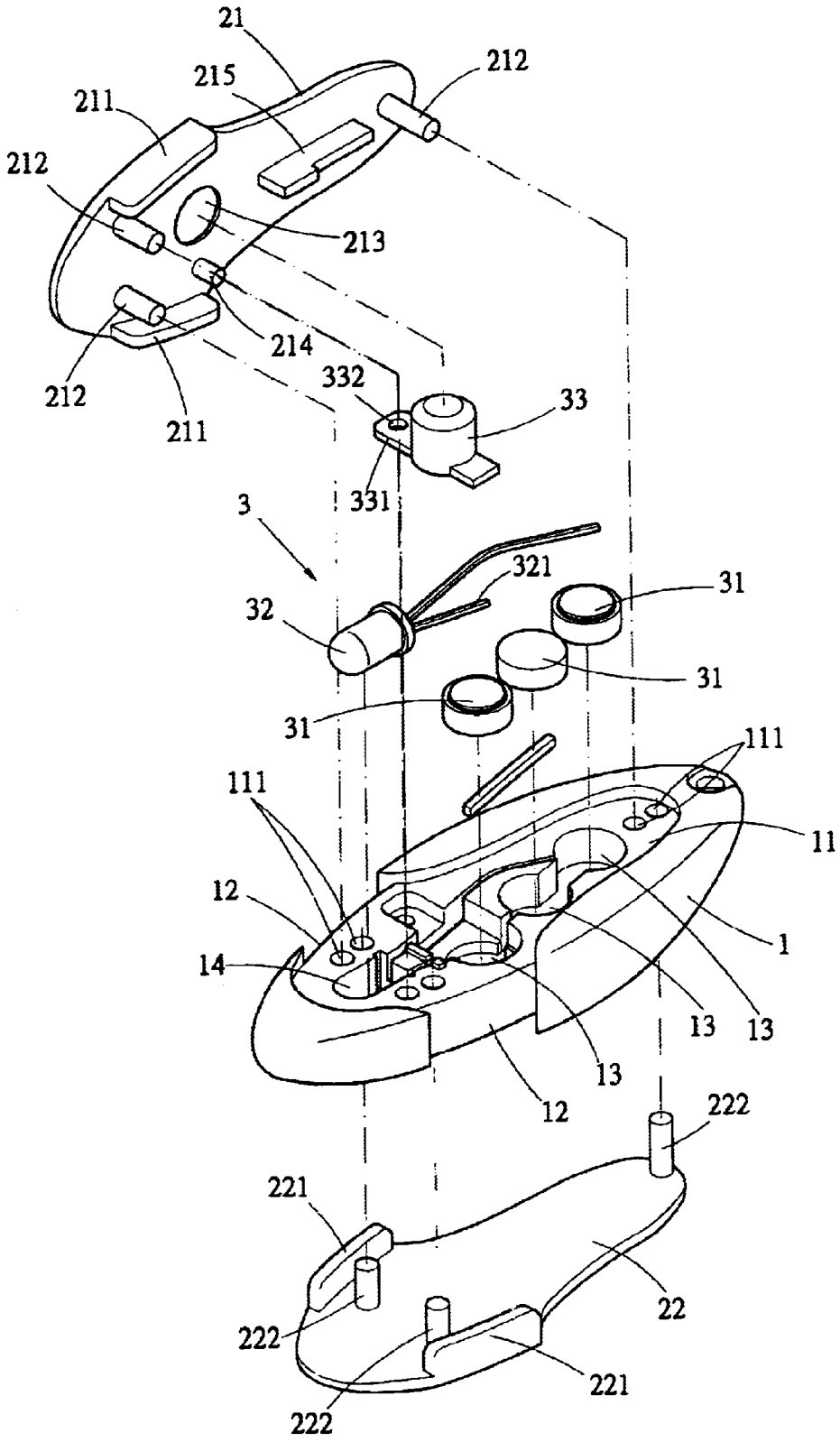
FIG. 2 is an analytic perspective view showing the structure of the key ring of the present invention.

Concerning the improved cover assembling structure of a key ring of the present invention, the key ring as shown in FIGS. 1 and 2 is comprised of a main body 1 as the main structural member of the key ring, it is provided respectively on an upper and a lower surface thereof with recesses 11 for embedding therein respectively an upper cover 21 and a lower cover 22. The recesses 11 are provided at middle peripheral sections of the lateral sides of the main body 1 with notches 12, and at least an insertion hole 111 is provided in each of the areas at the middle sections of the recesses 11 of the upper and the lower surfaces. The recess 11 on one of the upper and the lower surfaces of the main body 1 is provided therein with a battery insertion seat 13 and an electric element insertion seat 14 etc. in favor of that the main body 1 can be provided therein with a set of accessories 3 including a group of batteries 31 and an electric element 32. In the embodiment shown, the electric element 32 is an LED member that can be lightened under the function of power of the batteries 31, so that the entire key ring gets an effect of light emitting for illumination.

The upper and the lower covers 21, 22 can be assembled with the main body 1, and can be inserted into the recesses 11 of the main body The upper and the lower covers 21, 22 have contours in coincidence respectively with those of the recesses 11, and are provided with lateral wing pieces 211, 221 for inserting into the notches 12; the inner sides of the upper and the lower covers 21, 22 to be covered over the main body 1 are provided with insertion stubs 212, 222 in corresponding to the insertion holes 111. The thickness of the upper and the lower covers 21, 22 as well as the lateral wing pieces 211,221 is respectively exactly same as the depths of the recesses 11 of the main body 1 and the notches 12. The upper cover 21 in opposition to the set of accessories 3 on the main body 1 is provided thereon with a push button 33 for controlling turning on/off of the power line connecting the batteries 31 and the electric element 32. The push button 33 is allocated at a position in corresponding to that of the junction of a wire leg 321 of the electric element 32 in connecting with the batteries 31. The upper cover 21 is also provided thereon with an insertion hole 213 and a positioning stub 214 for installing the push button 33; the push button 33 has a positioning plate 331 extending therefrom, a positioning hole 332 is provided on the positioning plate 331 in order that the push button 33 can be inserted into the insertion hole 213 on the upper cover 21. By insertion connecting of the positioning stub 214 with the positioning hole 332, a limiting action is provided for the push button 33 to prevent the latter from displacement, then the upper cover 21 is put on to cover and hide the batteries 31 and the electric element 32, so that the user can directly press the push button 33 on the upper cover 21 to control operation of the set of accessories 3.

Figure 3:
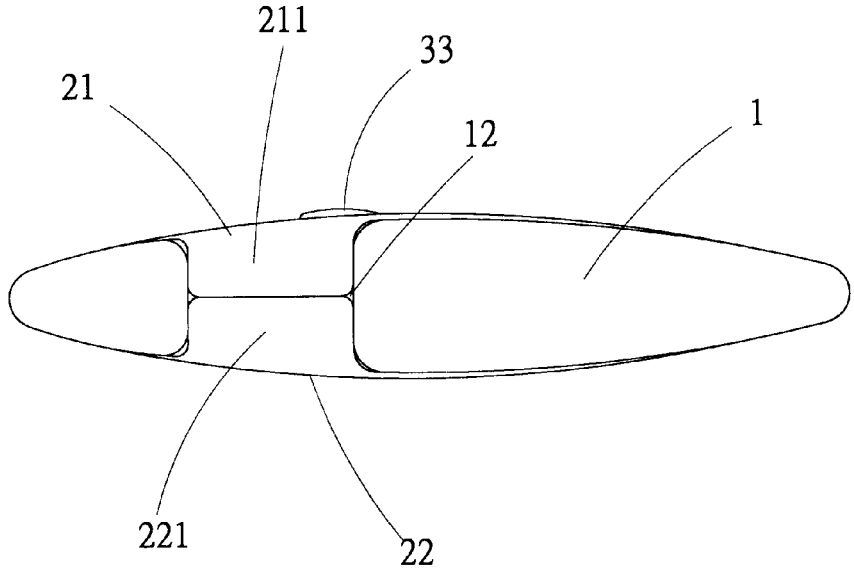
FIG. 3 is a side view of the structure of the key ring of the present invention.

Accordingly, the entire key ring can allow the upper and the lower covers 21, 22 to insert into the recesses 11 of the main body 1, and the lateral wing pieces 211, 221 respectively of the upper and the lower covers 21, 22 are insertion engaged with the insert notches 12 provided on the main body 1 to complete assembling of the entire key ring in such a extremely simple covering action. Now, the upper and the lower covers 21, 22 are completely embedded respectively in the recesses 11 on the main body 1 to form a firm key ring structure with an integrated and smooth surface. Particularly, as shown in FIG. 3, the upper and the lower covers 21, 22 are connected with each other at middle peripheral sections of the lateral sides of the main body 1 by means of the lateral wing pieces 211, 221, and these connecting areas will be the prying areas for dismantling the assembly. The prying area is hidden in notches 12 provided at middle peripheral sections of the lateral sides of the main body 1, in order to avoid prying the upper and the lower covers 21, 22 during use.

And more, as shown in FIGS. 2 and 3, the main body 1 can be made of elastic, transparent as well as insulating material in order that the entire key ring gets an effect of light emitting; and the upper and the lower covers 21, 22 thereof can be made of hard material with electric conductive capability. The upper cover 21 is provided at the a location in corresponding to that of the batteries 31 with an electric conductive portion 215 to be connected with the batteries 31, so that the upper cover 21 can be used to directly make connection among the batteries 31. Thereby, when the upper and the lower covers 21, 22 are removed, the main body 1 can be slightly bent suitably to make the edges of the upper and the lower covers 21, 22 raised to allow inserting of a fingernail to open the upper and the lower covers 21, 22, this can be beneficial to maintenance and repairing of the set of accessories 3.

The improved cover assembling structure of a key ring of the present invention is provided respectively on an upper and a lower surface of the main body of the key ring with recesses for embedding therein respectively an upper and a lower cover. The recesses are provided at middle peripheral sections of the lateral sides of the main body with notches, and at least an insertion hole is provided in each of the areas at the middle sections of the recesses of the upper and the lower surfaces. The upper and the lower covers have contours in coincidence respectively with those of the recesses, and are provided with lateral wing pieces for inserting into the notches; the inner sides of the upper and the lower covers to be covered over the main body are provided with insertion stubs in corresponding to the insertion holes. The thickness of the upper and the lower covers as well as the lateral wing pieces is respectively exactly same as the depths of the recesses of the main body and the notches. The upper and the lower covers are put on to cover the recesses of the main body, and the insertion stubs provided on the upper and the lower covers are insertion engaged with the insertion holes provided on the main body to complete assembling of the entire key ring. Now, the upper and the lower covers are completely embedded respectively in the recesses on the main body to form a firm key ring structure with an integrated and smooth surface.

Thereby, the present invention provides a better covering assembly for a key ring. Having thus described my invention, what I claim as new and desire to be secured by Letters Patent of the United States are:

1. An improved cover assembling structure of a key ring, said key ring is comprised of:

a main body as the main structural member of said key ring, it is provided respectively on an upper and a lower surface thereof with recesses for embedding therein respectively an upper cover and a lower cover; said recesses are provided at middle peripheral sections of the lateral sides of said main body with notches, and at least an insertion hole is provided in each of the areas at middle sections of said recesses of said upper and lower surfaces;

said upper and lower covers are inserted into said recesses of said main body, have contours in coincidence respectively with those of said recesses, and are provided with lateral wing pieces for inserting into said notches; the inner sides of said upper and lower covers to be covered over said main body are provided with insertion stubs in corresponding to said insertion holes; the thickness of said upper and lower covers as well as said lateral wing pieces is respectively substantially the same as the depths of said recesses of said main body and said notches;

accordingly, said upper and lower covers are adapted to inserting into said recesses of said main body, and said lateral wing pieces respectively of said upper and lower covers are insertion engaged with said notches provided on said main body to complete assembling of said key ring; now, said upper and lower covers are completely embedded respectively in said recesses on said main body to form a firm key ring structure with an integrated and smooth surface; said upper and the lower covers are connected with each other at said middle peripheral sections of said lateral sides of said main body by means of said lateral wing pieces, and these connecting areas will be the prying areas for dismantling the assembly of said key ring, said prying areas are hidden in said notches provided at said middle peripheral sections of said lateral sides of said main body, in order to avoid prying said upper and lower covers during use.

2. The improved cover assembling structure of a key ring as in claim 1, wherein said recess on one of said upper and lower surfaces of said main body is provided therein with a battery insertion seat and an electric element insertion seat in favor of that said main body is provided therein with a set of accessories including a group of batteries and an electric element; said upper cover is provided thereon with a push button for controlling turning on/off of the power line connecting said batteries and said electric element, said upper cover obscure a said batteries and said electric element when it covers, so that a user needs only to directly press said push button on said upper cover to control operation of said set of accessories.

3. The improved cover assembling structure of a key ring as in claim 2, wherein said upper cover is provided thereon with an insertion hole and a positioning stub for installing said push button; said push button has an positioning plate extending therefrom, a positioning hole is provided on said positioning plate in order that said push button is inserted into said insertion hole on said upper cover; by insertion connecting of said positioning stub with said positioning hole, a limiting action is provided for said push button to prevent the latter from displacement.

4. The improved cover assembling structure of a key ring as in claim 2, wherein said push button is allocated at a position in corresponding to that of the junction of a wire leg of said electric element in connecting with said batteries.

5. The improved cover assembling structure of a key ring as in claim 2, wherein said main body is made of elastic as well as insulating material, said upper and lower covers are made of hard material with electric conductive capability, said upper cover is provided at the a location in corresponding to that of said batteries with an electric conductive portion to be connected with said batteries, so that said upper cover is used to directly make connection among said batteries.

6. The improved cover assembling structure of a key ring as in claim 5, wherein said electric element is an LED member.

7. The improved cover assembling structure of a key ring as in claim 6, wherein said main body is made of transparent material.

* * * * *